US005244003A

United States Patent [19]

Boomgaarden

[11] Patent Number: 5,244,003

[45] Date of Patent: Sep. 14, 1993

[54] TELESCOPIC DRAIN HOSE

[75] Inventor: Steven L. Boomgaarden, Rosemount, Minn.

[73] Assignee: Tennant Company, Minneapolis, Minn.

[21] Appl. No.: 870,094

[22] Filed: Apr. 16, 1992

Related U.S. Application Data

[63] Continuation of Ser. No. 642,654, Jan. 17, 1991, abandoned.

[51] Int. Cl.[5] ..... E03B 1/00

[52] U.S. Cl. ..... 137/1; 137/355.16; 137/590; 137/899; 15/320; 15/353

[58] Field of Search ..... 15/320, 353; 137/355.12, 355.16, 590, 577, 577.5, 899, 1

[56] References Cited

U.S. PATENT DOCUMENTS

| | | | |
|---|---|---|---|
| 397,374 | 2/1889 | Maddox | 137/590 |
| 628,931 | 7/1899 | Farson | 137/590 |
| 2,353,530 | 7/1944 | Walker | 137/577.5 |
| 2,726,807 | 12/1955 | Lewis | 15/320 |
| 3,165,774 | 1/1965 | Barba | 15/353 |
| 3,343,199 | 9/1967 | Nolte | 15/319 |
| 4,133,347 | 1/1979 | Mercer | 137/355.16 |
| 4,196,492 | 4/1980 | Johnson et al. | 15/320 |
| 4,223,702 | 9/1980 | Cook | 138/106 |
| 4,586,208 | 5/1986 | Trevarthen | 8/158 |
| 4,667,364 | 5/1987 | Meili | 15/320 |
| 4,838,315 | 6/1989 | Gunn | 137/355.16 |
| 4,858,269 | 6/1989 | Ostroski | 15/327 |

*Primary Examiner*—A. Michael Chambers
*Attorney, Agent, or Firm*—Kinzer, Plyer, Dorn, McEachran & Jambor

[57] ABSTRACT

This is a drain hose for a tank such as on a floor scrubbing machine and a means for attaching it to the tank. When not in use the hose is stored inside the tank, where it is protected from damage such as may occur to externally stored hoses. When it is to be used the hose is pulled from the tank and extended to a suitable site such as a floor drain and the contents of the tank are emptied through it. After use the hose may be pushed back into the tank again. The means for attaching the hose to the tank may include a cover over an opening in the tank which is amply large to permit cleaning out the tank.

11 Claims, 4 Drawing Sheets

TELESCOPIC DRAIN HOSE

This is a continuation of copending application Ser. No. 07/642,654 filed on Jan. 17, 1991 now abandoned.

BACKGROUND OF THE INVENTION

It is often necessary to empty a tank by connecting a drain hose to it and running that hose to a floor drain or other acceptable drain site. An example of where this occurs might be in connection with the use of a floor scrubbing machine such as is found in U.S. Pat. No. 5,016,310. Such scrubbers carry tanks for holding clean scrubbing solution before it is applied to a floor and soiled solution picked up from a floor that has been scrubbed. A problem sometimes arises as to where to store a drain hose between uses, and in floor scrubbers this has been especially true. There seems to be no good place to put them. In the past they have been secured to the outside of the machine with spring clips, but the clips get bent out of shape easily and the hoses are subject to damage from bumping nearby objects as the machine moves around. Commonly one end of a hose is permanently attached to a drain fitting at the bottom of a tank and for storage its free end is elevated above the liquid level in the tank to prevent dribbling out of the end of the hose between uses. In the case of soiled scrubbing solution recovered from a floor the suspended dirt in the liquid tends to settle in the bend where the hose curves upward and the hose may become plugged. Then a steel rod pushed into the hose to clear it may punch a hole in it. In general it has been a situation begging for improvement.

SUMMARY OF THE INVENTION

The invention comprises a drain hose for a tank, a means of storing it within the tank between uses, and a means for pulling it out when it is desired to drain the tank. The hose has a suitable diameter for draining the related tank in a reasonable time into a suitable drain site, e.g. a floor drain. It is made of a flexible material such as vinyl, and has a smooth outer surface. The tank has a round drain opening at the bottom of a side wall which is large enough to permit cleaning out the tank. The drain opening has a cover with a hole in it that is fitted with a resilient circular seal which matches the outside diameter of the hose. The hose may be pushed through this seal into the tank for storage, or pulled out for use, without leakage around the hose. Means are provided to stop the hose travel when it has been pulled out to its maximum distance, and means are provided to secure the hose from being inadvertently pulled out when it is stored inside the tank. A closure is also provided for closing off the free end of the hose while it is in storage or is being pulled out of the tank to a desired position at a drain site such as a floor drain. At that time it can be opened by opening the closure, which may be an end cap or optionally a valve on the end of the hose, to drain the tank. The invention solves the problem of where to store the hose and protects it against damage while in storage. There is no upward curvature of the hose in storage, so dirt does not tend to collect in it, and therefore problems associated with cleaning it are avoided.

DETAILED DESCRIPTION OF THE ILLUSTRATED EMBODIMENT

Figure 1:
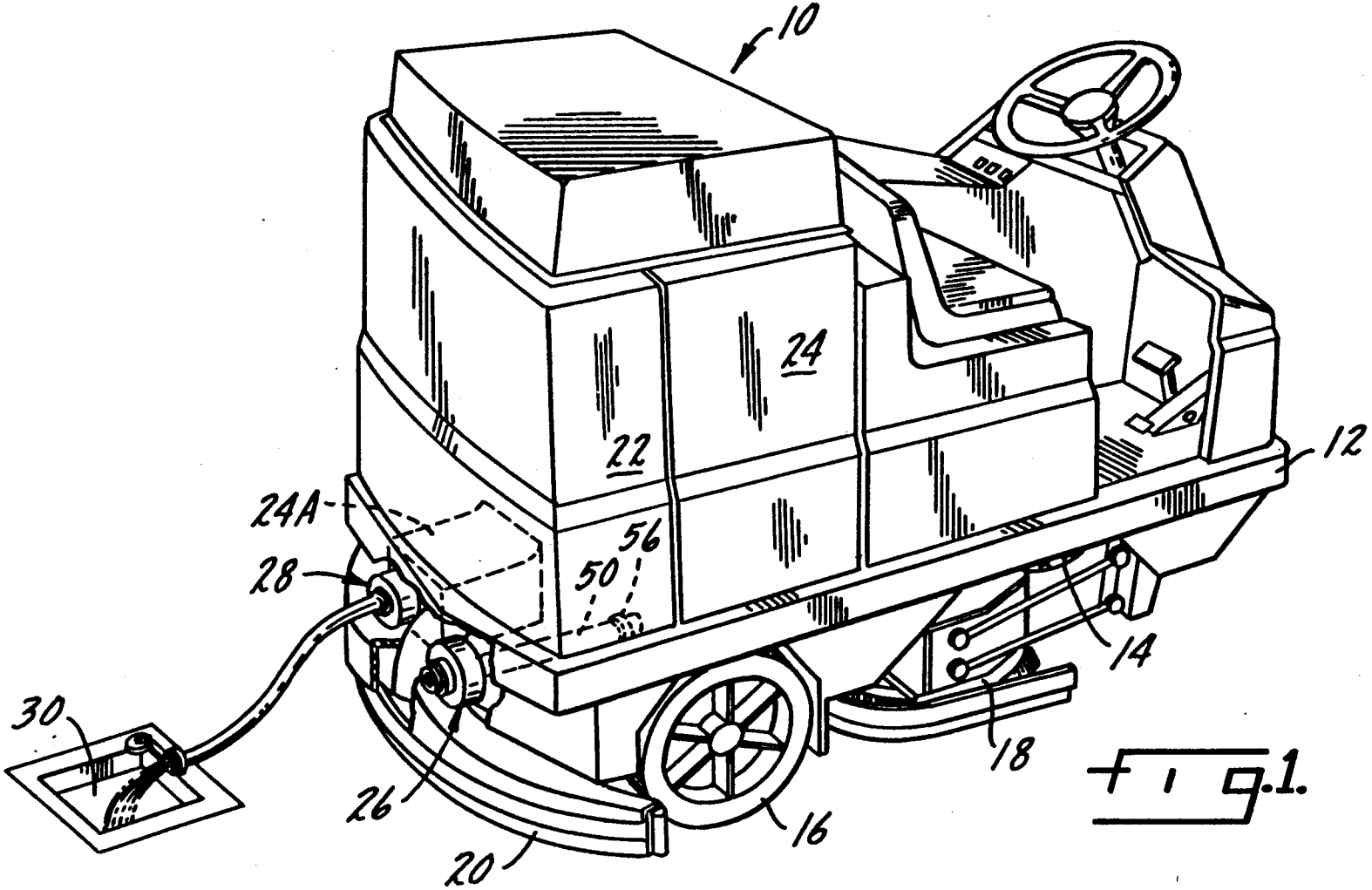
FIG. 1 is a perspective view of a floor scrubbing machine which makes use of the present invention.

FIG. 1 shows an industrial floor scrubbing machine, commonly referred to as a scrubber, and generally designated by the number 10. It utilizes the present invention, which will be described in detail. In all other respects, however, it may be a conventional scrubber. It has a frame 12 which supports the various machine components. It is supported by a single front wheel, partially shown at 14, which is powered and steerable. Two rear wheels 16 (only one shown) support the rest of the weight. It may be powered by batteries and electric motors. Clean scrubbing solution is carried in a solution tank 22 and dispensed to the floor while a scrub head 18 mounted amidships provides two powered rotating scrub brushes which do the actual work of scrubbing the floor. A vacuum pickup squeegee 20 removes soiled scrubbing solution from the floor and deposits it in a recovery tank 24 for later disposal.

Tanks 22 and 24 are preferably made of plastic, and may be rotationally molded. Means are provided at the rear of the machine to drain both tanks, and these means are the subject of this patent. There are two tank drains, shown generally at 26 and 28. Drain 26 connects to and drains the solution tank 22. Drain 28 connects to and drains the recovery tank 24 through an extended portion of tank 24 shown in dotted outline as 24A. This extension is an integral part of recovery tank 24 which passes under a raised bottom portion of solution tank 22 so that both drain ports may be located at the rear of the machine where they will be conveniently accessible.

As explained earlier in the "Summary of the Invention", the means which are provided for draining the tanks comprise flexible hoses which may be stored within the tanks when not in use, or pulled out when needed. As illustrated in FIG. 1, the drain hose for the recovery tank 24 is extended and the contents of tank 24 are being drained into a floor drain 30. Also in FIG. 1 the drain hose for the solution tank 22 is shown in its retracted or storage position. The hose is shown only in dotted outline in FIG. 1 because it is within the tank, but a detailed description will be given by reference to FIGS. 2 and 3. The two drains are essentially alike, and so only one will be described. We have elected the solution tank drain 26 for this.

Figure 2:
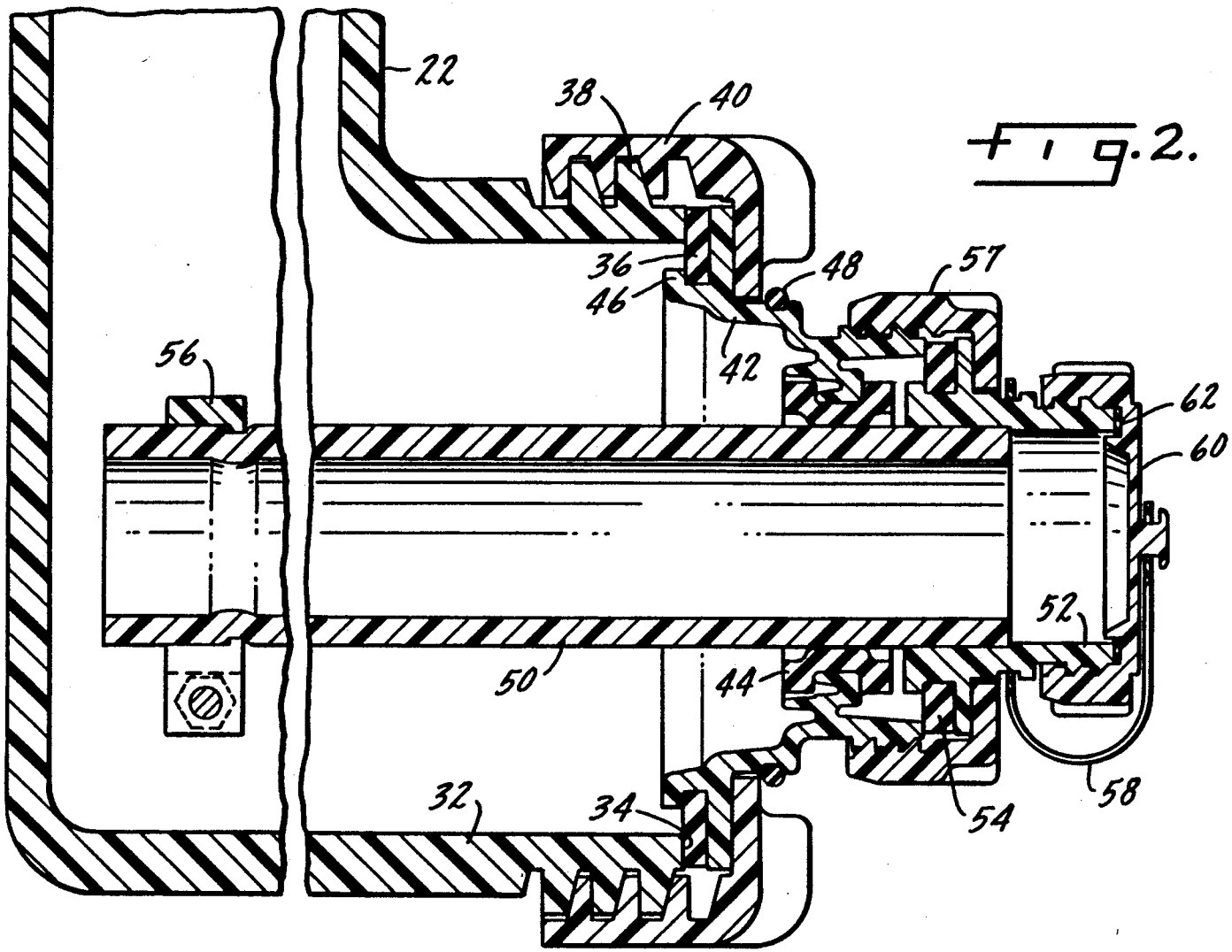
FIG. 2 is a vertical section taken through a tank outlet and drain hose with the hose in retracted or storage position.

Referring now to FIG. 2, there is shown a typical tank which may be considered to be the solution tank 22 of the scrubber shown in FIG. 1. However, it could also be some other tank, for the invention is applicable to many tanks other than the one illustrated. A circular outlet port 32 is provided at the bottom of one side wall of the tank as an integral part of the tank. It has an inside diameter large enough to facilitate any cleaning out of the tank that may be required from time to time. In the scrubber application an inside diameter of about five inches was found to be adequate. The outlet port 32 has a square face 34 to receive a sealing gasket 36 and external threads 38 which may advantageously be of buttress form. These threads receive a screw-on tank cap 40, which holds the rest of the parts to the tank.

An insert cover 42 has a circular hose seal 44 inserted into the round hole at its center and sealing gasket 36 is snapped over its inner flange 46. Tank cap 40 is slipped over insert cover 42 as shown and loosely secured with o-ring 48.

Drain hose 50 may be made of extruded vinyl. It has an inside diameter large enough to drain the tank in an acceptable time. For the scrubber a 1.25-inch i.d. was adequate, and the o.d. was 1.73 inches. It is solvent bonded to hose adapter 52 which has lid gasket 54 snapped over its inner flange. Hose 50 is pushed through hose seal 44 and hose clamp 56 is tightened around it near its end. When the hose is in storage position as shown in FIG. 2 it is retained by drain hose cap 57, and lid gasket 54 provides redundant assurance that there will be no leakage around the hose 50 in case hose seal 44 should leak.

A closure is needed to close the end of the hose, and hose cap 60 is one form of closure that may be used. An alternative form will be described later. Cap gasket 62 is cemented to the inner surface of cap 60 and seals against hose adapter 52 when hose cap 60 is screwed on tightly. A flexible tether 58 has a hole at one end large enough to snap over and fit loosely around the outer flange of hose adapter 52 and a small hole at the other end which snaps over and fits loosely around a button at the center of hose cap 60. The tether 58 serves the dual functions of loosely retaining drain hose cap 57 and preventing hose cap 60 from being misplaced when it is removed to drain the tank.

The gaskets, seal, o-ring and tether are made of an elastomeric material which is compatible with the contents that will be placed in the tank. Other parts are a suitable molded plastic.

Figure 3:
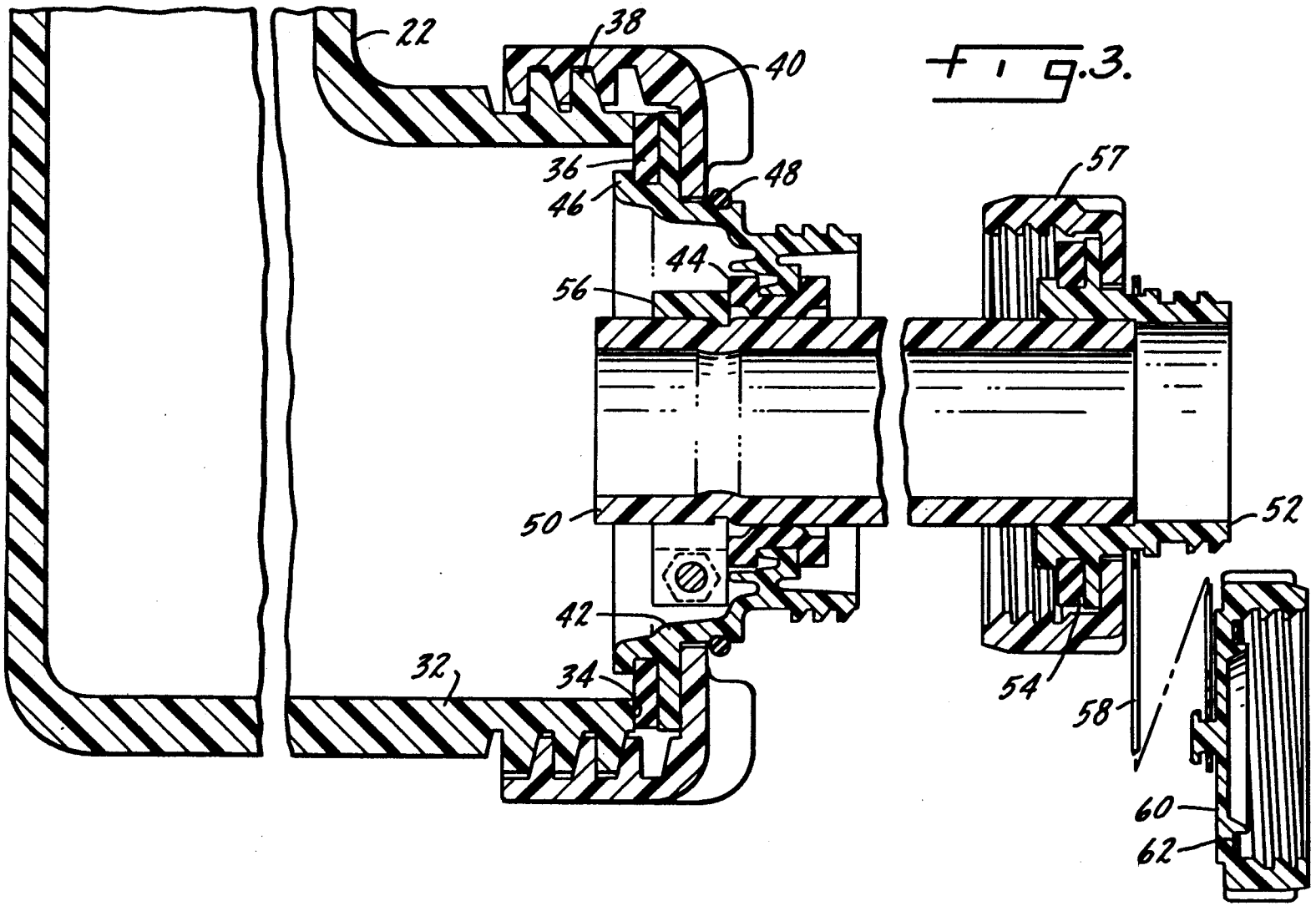
FIG. 3 is a vertical section similar to FIG. 2 but with the hose in extended or use position.

The same parts are shown in FIG. 3 as in FIG. 2, but in FIG. 3 the hose 50 has been pulled out of the tank 22 and the end closure 60 has been removed from the hose adapter 52. There is thus an open passageway through the hose for the contents of the tank to drain out. This would be done when it is desired to drain the tank to a drain site such as floor drain 30 in FIG. 1.

The sequence of events would be first to unscrew drain hose cap 57 from insert cover 42. Then by grasping either cap 57 or cap 60, pull out the drain hose 50 until the hose clamp 56 bumps against hose seal 44. This gives the maximum distance that the hose can be pulled out; obviously it can be pulled out for only part of that distance if desired. The end of the hose is then positioned over the drain site and the end closure, hose cap 60, is unscrewed from the hose adapter 52. The tank contents will then flow to the drain site. After draining, reversing the above procedure will stow the hose back in the tank.

It should be noted that tank cap 40 can be unscrewed whether the hose is in or out of the tank, and the hose and all its related parts can be removed from the tank. This will give unrestricted access to the outlet port 32 for cleaning out sediment or other solid material in the tank. Such tools as a long handled scraper and a garden hose are typically used for this when necessary.

Figure 4:
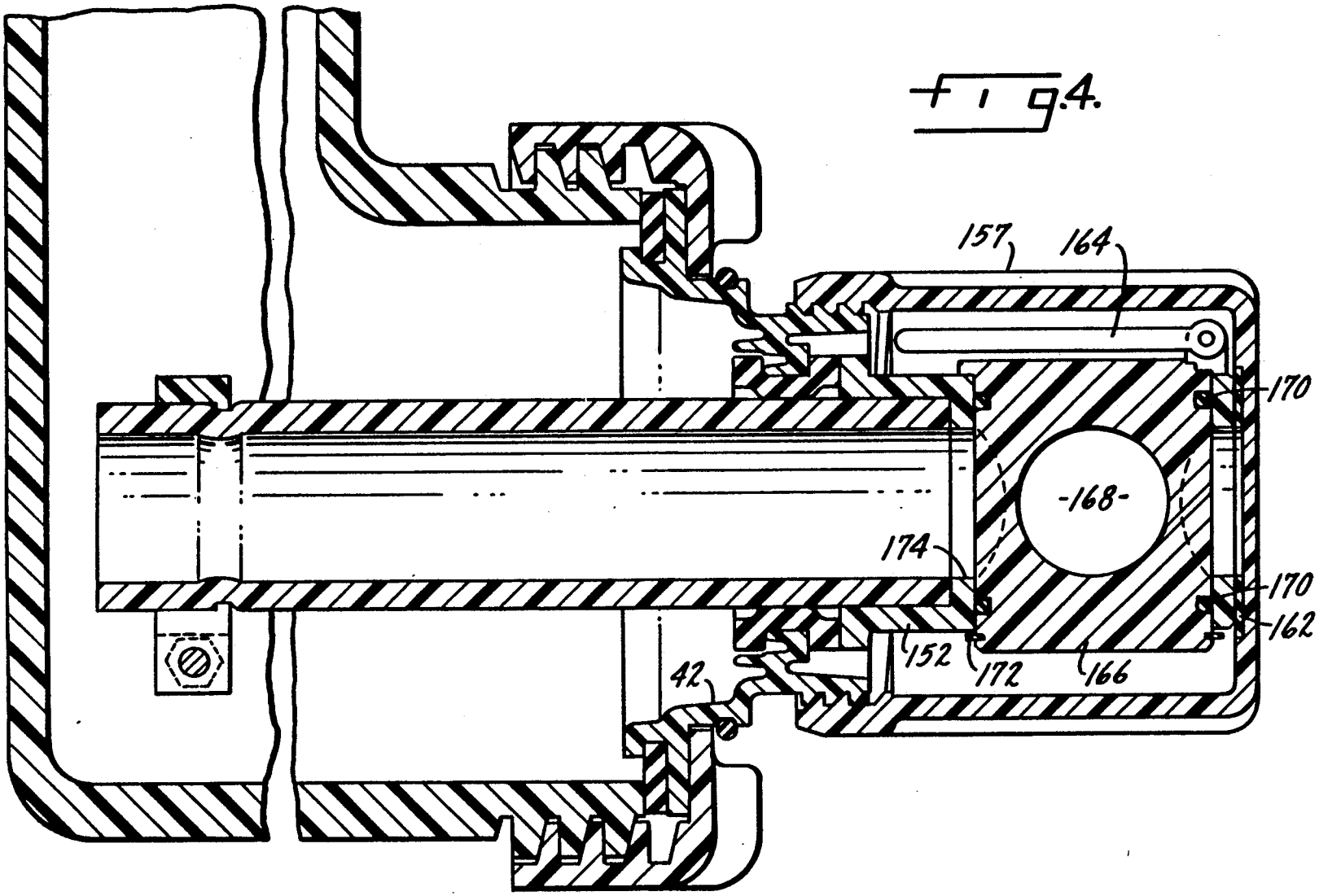
FIG. 4 is a vertical section similar to FIG. 2 showing an alternative construction of the invention.

When the drain hose is in position over a drain site and the hose cap 60 is removed there will be a rush of liquid from the tank which may wet the hand of the person doing the job. With some liquids that may be undesirable. FIG. 4 shows an alternative construction which can be used to avoid this. In FIG. 4 the parts are all the same as in FIG. 2 except those that are numbered. It will be seen that hose adapter 52 of FIG. 2 has been replaced with a modified hose adapter 152 which incorporates the body for a conventional plug valve. A new cover 157 with cover gasket 162 cemented into it is screwed to insert cover 42 to cover the entire area and provide redundant protection against leakage when the hose is in stored position. This cover is removed for tank draining. A person can then grasp hose adapter 152 and pull the hose out to the drain site. One can then grasp hinged valve handle 164, swing it clockwise 180 degrees, and twist it to turn the valve plug 90 degrees from its position as shown in FIG. 4. This will move the hole 168 in valve plug 166 from the position shown to a position in line with the horizontal bore 174 of the valve body. The liquid will then drain out freely, and the operator will not have had to put his or her hand in the stream. O-rings 170 seal valve plug 166 in the transverse bore of valve body 152 and retaining ring 172 retains the plug in the body after the manner of conventional plug valves. Of course, it will be appreciated by anyone versed in the art that the valve arrangement described here is only one of many different valves which could be used to achieve the end.

With these and other variations in mind it is desired that the inventive subject matter be unrestricted except by the appended claims The embodiments of the invention in which an exclusive property or privilege is claimed are defined as follows:

1. A method of storing and using a flexible drain hose for a liquid containing tank on a floor scrubber whereby the hose when not in use is stored within the tank, and when in use the hose may be withdrawn from the tank and may be bent as needed to direct it to a suitable drain site into which the contents of the tank may be emptied, the hose being continuously connected to the tank during storage, withdrawal and use in a manner which permits liquid from the tank within the hose while preventing the escape of liquid from the tank around the outside of the hose.

2. The method of claim 1 for storage and use of a drain hose for a liquid containing tank in which a closure is provided for one end of the hose, said closure being a cap.

3. The method of claim 1 for storage and use of a drain hose for a liquid containing tank in which the drain outlet of the tank where the drain hose is connected is at or near the bottom of a side wall of the tank.

4. The method of claim 1 for storage and use of a drain hose for a liquid containing tank in which the means of connecting the hose to the tank also provides an opening into the tank, said opening being of adequate size to permit cleaning out the tank.

5. The method of claim 1 for storage and use of a drain hose for a liquid containing tank in which a closure is provided for one end of the hose, said closure being a valve.

6. A floor scrubbing machine having at least one tank to contain liquid scrubbing solution, a flexible drain hose for each tank, each tank and its related hose being so constructed that the hose when not in use is stored within the tank, and when in use the hose may be withdrawn from the tank and may be bent as needed to direct it to a suitable drain site into which the contents of the tank may be emptied, the hose being continuously connected to the tank during storage, withdrawal and use in a manner which permits liquid from the tank within the hose while preventing the escape of liquid from the tank around the outside of the hose.

7. In a drain arrangement for a tank on a floor scrubber constructed and arranged to hold a liquid, an opening at the bottom of the tank, a flexible drain hose in the opening constructed and arranged for axial movement between an inner stored position in which it is substantially completely within the tank and an extended drain position in which its outer end extends a substantial distance from the tank, and a cap on the outer end of the drain hose adapted to be removed so that the liquid content of the tank may be drained out through the hose when the cap is removed.

8. The structure of claim 7 further characterized by and including a manually operable valve on the outer end of the drain hose to control the flow of liquid through the drain hose.

9. The structure of claim 7 further characterized by and including a manually operable holder for the outer end of the hose constructed and arranged to releasably hold the hose in its inner position and, upon release, to allow the hose to be manually withdrawn to its extended position.

10. The floor scrubber drain arrangement of claim 7 further characterized by and including a stop member on the innermost end of said hose, and means associated with said opening cooperating with said stop member to prevent complete removal of said hose from said tank.

11. The floor scrubber drain arrangement of claim 10 further characterized in that said means associated with said opening is removably attached to said opening to provide for the removal thereof and the complete removal of said hose from said tank.

* * * * *